US005464130A

United States Patent [19]

Tasaki

[11] Patent Number: 5,464,130

[45] Date of Patent: Nov. 7, 1995

[54] PISTON OF PUMP SECTION OF TRIGGER-TYPE LIQUID DISPENSER

[75] Inventor: Takaharu Tasaki, Tokyo, Japan

[73] Assignee: Yoshino Kogyosho Co., Ltd., Tokyo, Japan

[21] Appl. No.: 232,115

[22] PCT Filed: Sep. 3, 1992

[86] PCT No.: PCT/JP92/01125

§ 371 Date: May 3, 1994

§ 102(e) Date: May 3, 1994

[87] PCT Pub. No.: WO94/05911

PCT Pub. Date: Mar. 17, 1994

[51] Int. Cl.[6] ..... B67D 5/40

[52] U.S. Cl. ..... 222/383.1

[58] Field of Search ..... 222/382, 383.1; 239/333

[56] References Cited

U.S. PATENT DOCUMENTS

| | | | |
|---|---|---|---|
| 3,249,259 | 5/1966 | Corsette | 222/182 |
| 4,220,285 | 9/1980 | Gualdi | 222/383 |
| 4,357,798 | 11/1982 | Hung | 222/383 |
| 4,365,751 | 12/1982 | Saito et al. | 222/383 |
| 4,424,012 | 1/1984 | Westmoreland | 417/968 |
| 4,480,768 | 11/1984 | Martin | 222/383 |
| 4,489,861 | 12/1984 | Saito et al. | 417/507 |
| 4,489,890 | 12/1984 | Martin | 222/383 |
| 4,503,998 | 3/1985 | Martin | 239/333 |
| 4,527,741 | 7/1985 | Garneau | 222/383 |
| 4,596,344 | 6/1986 | Corsette | 222/383 |
| 4,618,077 | 10/1986 | Corsette | 222/383 |
| 4,640,444 | 2/1987 | Bundschuh | 222/383 |
| 4,646,969 | 3/1987 | Sorm et al. | 239/333 |
| 4,669,664 | 6/1987 | Garneau | 222/383 |
| 4,800,954 | 1/1989 | Noguchi et al. | 165/153 |
| 4,815,663 | 3/1989 | Tada | 239/333 |
| 4,819,835 | 4/1989 | Tasaki | 222/383 |
| 5,297,701 | 3/1994 | Steijns et al. | 222/383 |

FOREIGN PATENT DOCUMENTS

| | | |
|---|---|---|
| 57-32625 | 7/1982 | Japan . |
| 63-54968 | 3/1988 | Japan . |

*Primary Examiner*—Andres Kashnikow
*Assistant Examiner*—Philippe Derakshani
*Attorney, Agent, or Firm*—Oliff & Berridge

[57] ABSTRACT

A piston (101, 105) of a pump section (E) of a trigger-type liquid dispenser having integrally formed annular skirts (102, 104, 106, 108) extending respectively at an approach end and at a stroke end of the piston and held in close contact with an inner wall surface of a cylinder (H) of the pump section. The annular skirts (102, 104) have an overall axial length being as small as approximating to an axial length of an air intake port (100) provided on a peripheral wall of the cylinder (H). Alternatively, the annular skirt (106, 108) extending at the stroke end of the piston is provided with at least one notched section (109, 110) located at a position corresponding to the air intake port (23) provided on the peripheral wall of the cylinder. Thus, air is securely and surely introduced into the liquid container even if the trigger is moved repeatedly by only a short stroke in order to exhaust liquid at a reduced rate.

2 Claims, 8 Drawing Sheets

PISTON OF PUMP SECTION OF TRIGGER-TYPE LIQUID DISPENSER

FIELD OF THE INVENTION

This invention relates to an improvement in a piston of a pump section of a trigger-type liquid dispenser or sprayer to be fitted to an opening of a liquid container for exhausting or ejecting the liquid content of the container.

BACKGROUND OF THE INVENTION

FIG. 10 of the accompanying drawings illustrates a conventional trigger-type liquid dispenser or ejector to be fitted to an opening of a liquid container for exhausting or ejecting the liquid content in the container, where a tilted pump section A is arranged between a vertically disposed dispenser main body B and a horizontally disposed exhausting section C to allow a piston section D to have a sufficient stroke so that the liquid content in the container may be exhausted by a large amount in a single stroke. When, however, the dispenser is made of synthetic resin, it requires a cumbersome operation of being three-dimensionally released from a mold in X-, Y- and Z-directions, entailing necessarily the problem of the low productivity.

U.S. Pat. No. 4,819,835 discloses an improved dispenser for solving the problem of the low productivity.

FIG. 8 of the accompanying drawings schematically illustrates a trigger-type liquid dispenser disclosed in the U.S. Pat. No. 4,819,835. It includes a pump section E and an exhausting section F arranged horizontally and in parallel with each other so that the operation of releasing the molded product from the mold may be carried out only two-dimensionally in X- and Y-directions to raise the manufacturing efficiency.

However, since the pump section E is arranged horizontally, a stroke of a piston section G of the dispenser is reduced so as to reduce an amount of liquid that can be exhausted by a single stroke of the piston section G when compared with the dispenser of FIG. 10. In order to avoid the exhausted amount is reduced, the U.S. Patent discloses to use a cylinder H having a large diameter and a piston I having a large diameter so that the dispenser may exhaust a desired amount of liquid in as single stroke of the piston.

The trigger-type liquid dispenser illustrated in FIG. 8 also includes a container fitting section 1 and is rigidly fitted to the opening of a liquid container at the container fitting section 1. When a trigger 2 is pushed along the direction of arrow J, a press member 3 presses a horizontal groove 5 cut along a lateral side of a head 4 of a piston section G to displace piston I until its end surface 6 abuts a bottom wall 7 of a cylinder H. Thus, liquid contained in a cylinder chamber 8 is flowed out through a liquid inlet/output port 9 into a liquid path 10 so as to press a discharge valve body 11.

Then, the discharge valve body 11 is moved upwardly by the resilience of an elastic section 12 of the discharging valve body 11 to open a discharging valve seat 13. Thus, the fluid flows out from a discharging valve chamber 14 into a flow path 15 and then into other flow paths 16 and 17 so that it is finally exhausted or discharged through a nozzle 18.

Meanwhile, the piston I compresses a spring 19 contained therein, while the liquid in the liquid path 10 presses a ball valve 20 against a suction valve seat 21.

When the liquid is completely exhausted through the nozzle 18 and the trigger 2 is released, the piston I is returned to the position as shown in FIG. 8 by a resilient force of the spring 19. Thus, the cylinder chamber 8 is enlarged so as to decrease a pressure in the chamber 8. Since such negative pressure in the cylinder chamber 8 acts on the discharge valve body 11 and the ball valve 20, the discharge valve body 11 comes into contact with the discharge valve seat 13 to close the valve seat 13 and the ball valve 20 moves away from the suction valve seat 21 so that the liquid contained in the liquid container is drawn into the cylinder chamber 8 via a suction pipe 22, the liquid path 10 and the port 9 and stored there for the next exhausting operation.

An air intake port 23 is provided on a peripheral wall of said cylinder H and communicates with an inside of the liquid container, to which the container fitting section 1 is fitted, by way of air passages 24 and 25.

Said piston I is provided with an annular skirt 26 extending at an approach side (or the bottom wall 7 side of the cylinder H) and an annular skirt 27 extending at a stroke end (or an open end side of the cylinder H). The annular skirts 26, 27 are held in close contact with the inner wall surface of the cylinder H.

When the surface 6 of the approach end of said piston I abuts the bottom wall 7 of the cylinder H, a front edge 28 of the annular skirt 27 of the stroke end of said piston I is located closer to the bottom wall 7 of the cylinder H than the air port 23 of the cylinder. In such a case, the air intake port 23 communicates with an opening 29 of the cylinder H, and an air is introduced into the liquid container. On the other hand, when the piston I is located at the stroke end position as shown in FIG. 8, the air intake port 23 is located between the two annular skirts 26 and 27 and thus closed, so that the content of the liquid container may not flow out through the air intake port 23 if the liquid container is inadvertently turned upside down.

The above described trigger-type liquid dispenser disclosed in U.S. Pat. No. 4,819,835 can satisfactorily exhaust liquid so long as a user operates the trigger properly and the piston I is fully moved from the stroke end to the approach end of the piston I.

However, if the user repeatedly moves the trigger 2 by only a short stroke in an attempt to exhaust liquid at a reduced rate, the piston I is found in a position as illustrated in cross section in FIG. 9. Since the air intake port 23 of the cylinder H is located between the two annular skirts 26 and 27, the port 23 remains closed so that no air is allowed to flow into the liquid container, while the content of the liquid container is forced out repeatedly.

Thus, the pressure in the container is significantly reduced and the container would eventually be collapsed by atmospheric pressure.

SUMMARY OF THE INVENTION

It is, therefore, an object of the present invention to provide a piston of a pump section of a trigger-type liquid dispenser of the type as shown in FIG. 8 that can ensure air intake if the trigger is moved by only a short stroke and hence avoid any deformation or collapse of the liquid container by atmospheric pressure while maintaining its proper operation of liquid ejection.

According to the invention, the above object is achieved by providing a piston of a pump section of a trigger-type liquid dispenser having a first annular skirt extending at an approach end of the piston and a second annular skirt extending at a stroke end of the piston and formed integrally with the first annular skirt, said annular skirts being held in close contact with the inner wall surface of a cylinder of the pump section. An axial length of said second annular skirt extending at the stroke end is as small as possible, or said second annular skirt is provided with at least one notch section at a position corresponding to an air intake port of said cylinder.

BEST MODES OF CARRYING OUT THE INVENTION

Figure 8:
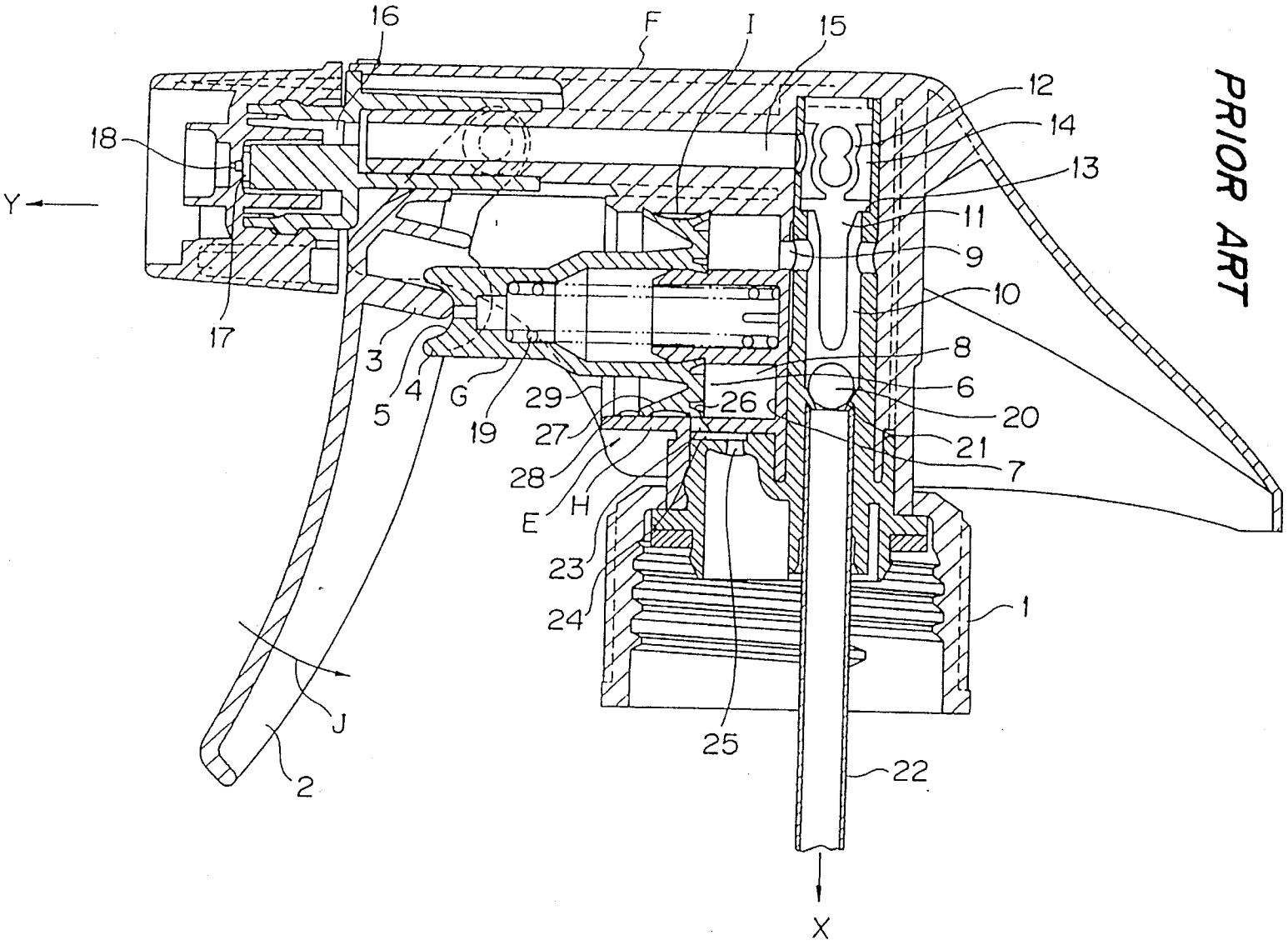
FIG. 8 PRIOR ART
FIG. 8 is a sectional side view of an improved trigger-type liquid dispenser.
Figure 9:
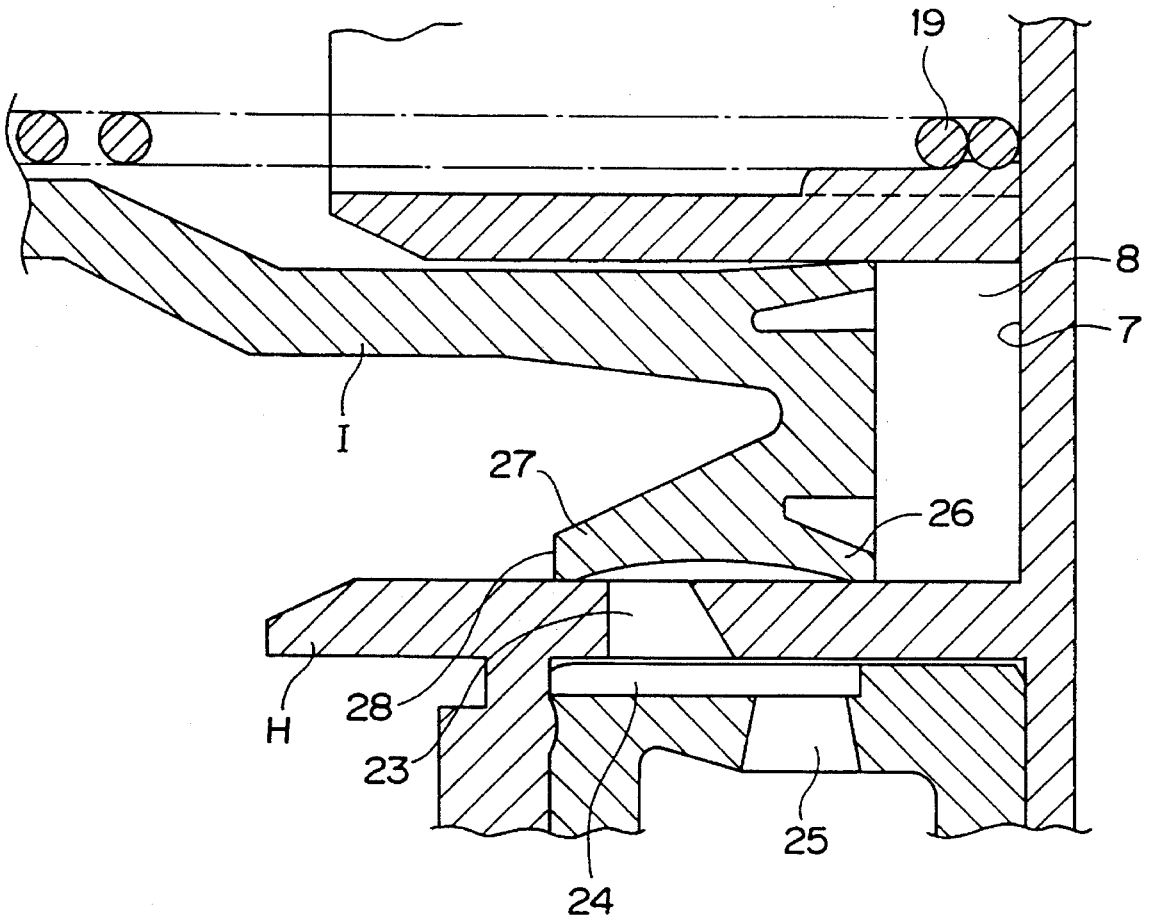
FIG. 9 is an enlarged partial sectional side view of the liquid dispenser of FIG. 8, showing the piston under an operating condition.
Figure 10:
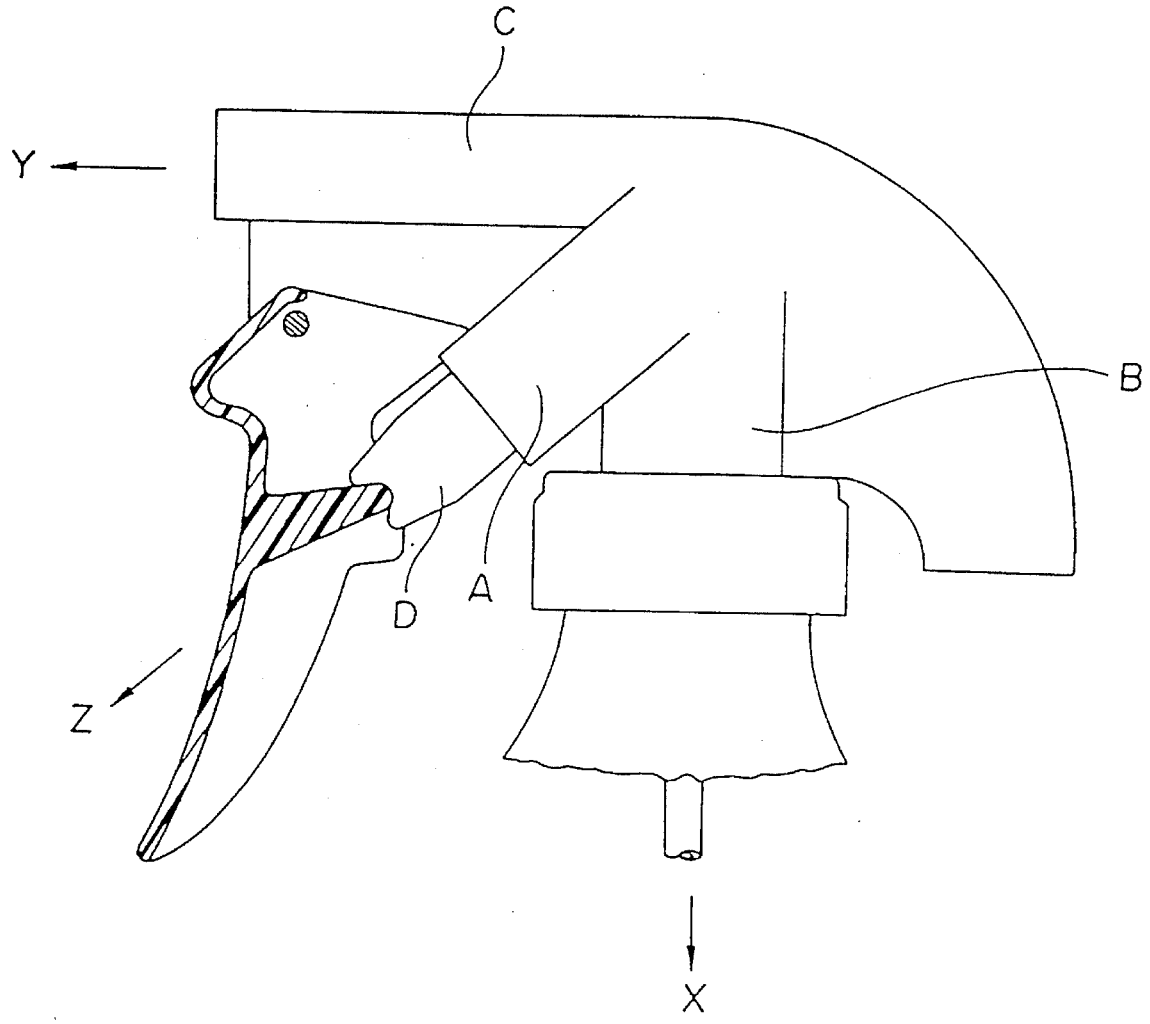
FIG. 10 PRIOR ART
FIG. 10 is a schematic side view of a conventional trigger-type liquid dispenser, showing it partly in cross section.

A trigger-type liquid dispenser for a piston according to the invention has a construction identical with the one illustrated in FIG. 8 except the piston. Thus, the present invention will be described referring to FIG. 8.

Figure 2:
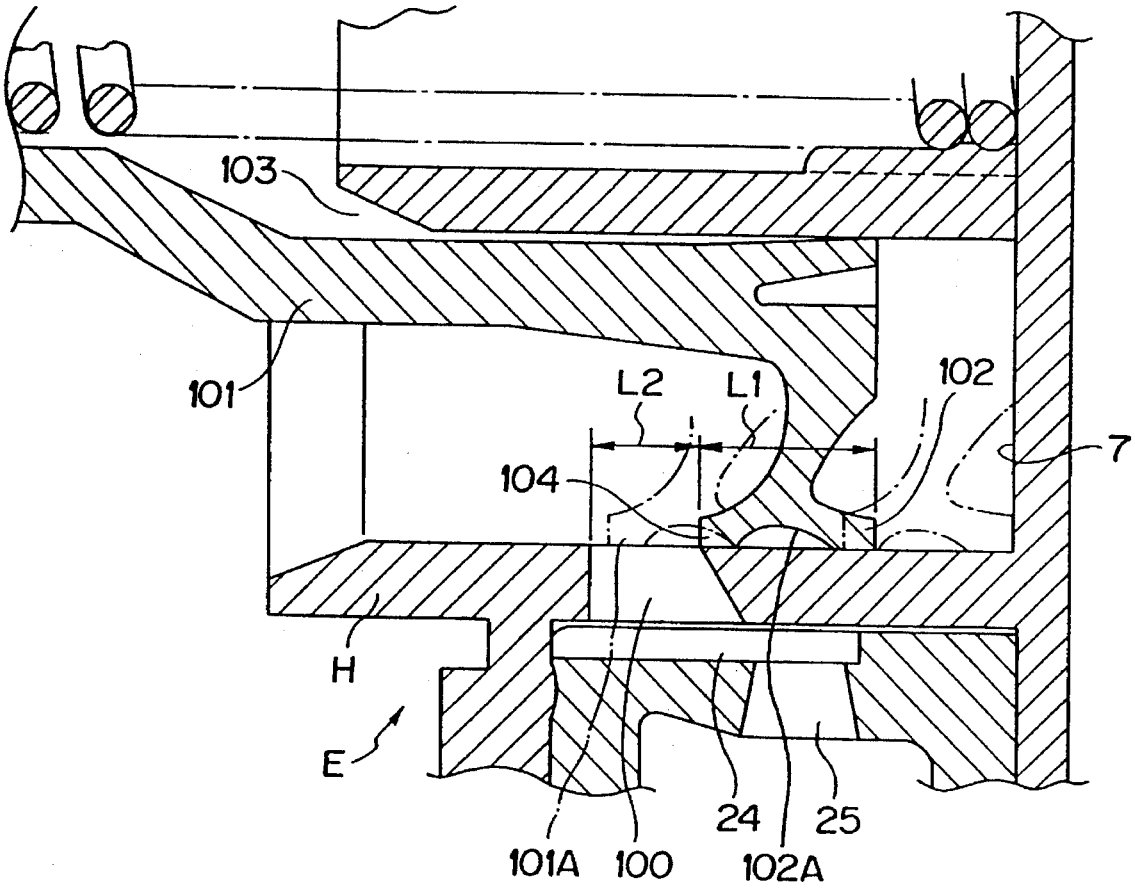
FIG. 2 is an enlarged partial sectional side view of the embodiment of the piston of FIG. 1, showing the piston under an operating condition.

Therefore, in FIG. 2, same reference symbols or numerals are, used to indicate components that are same as those of FIG. 8.

Referring to FIG. 2, an air intake port 100 is provided on a peripheral wall of the cylinder H of the pump section E and communicates with the liquid container, to which the trigger-type liquid dispenser is fitted, via air passages 24 and 25.

Figure 1:
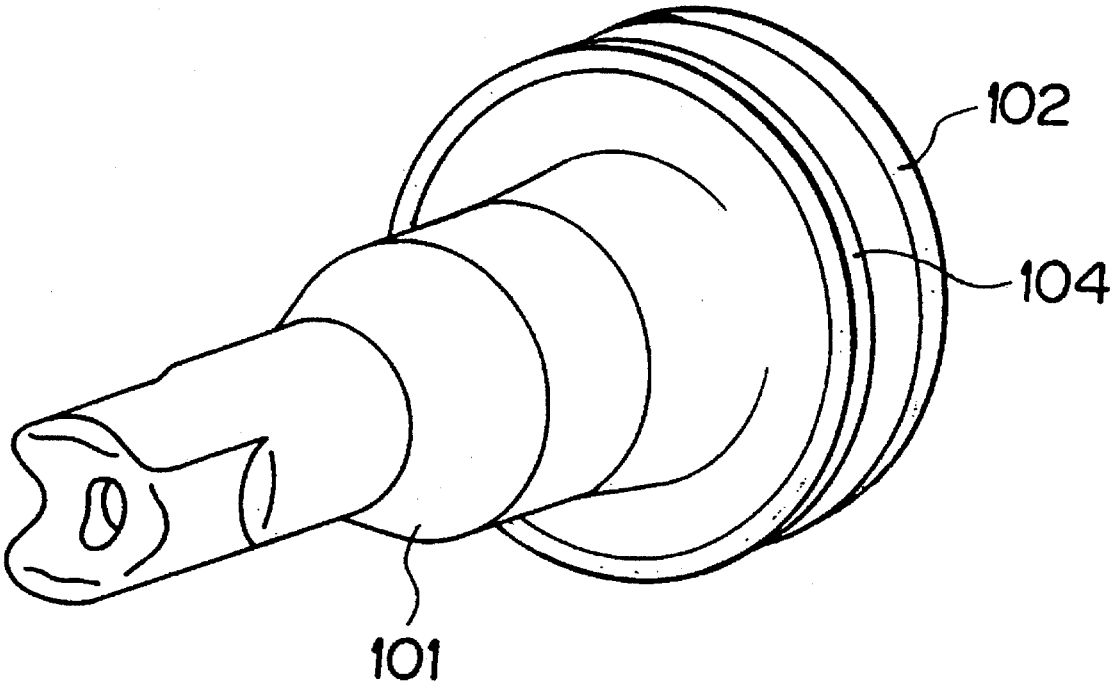
FIG. 1 is a schematic perspective view of a first embodiment of the invention.

A piston 101 is moved back and forth by means of a trigger 2. As illustrated in FIGS. 1 and 2, the piston 101 is provided and integrally formed with a first annular skirt 102 and a second annular skirt 104. The first annular skirt 102 extends at the approach end (or the bottom wall 7 side of the cylinder H) and held in close contact with the inner wall surface of the cylinder H. The second annular skirt 104 extends at the stroke end (or the opening 103 side of the cylinder H) and also held in close contact with the inner wall surface of the cylinder H.

A distance between a rear end of said annular skirt 102 and a front end of said annular skirt 104, or an overall axial length $L_1$ of the annular skirts 102 and 104 is as small as approximating to, or slightly longer than an axial length $L_2$ of the air intake port 100. The piston 101 has a curved portion 102A between the first 102 and the second annular skirt 104.

With this arrangement, if the user moves the trigger 2 by only a short stroke to exhaust little amount of liquid and consequently the piston 101 halts at a position as indicated by a solid line or a broken line 101A, air is securely introduced into the liquid container through the air intake port 100 to prevent any remarkably reduced pressure from occurring in the liquid container even if the user tries to repeatedly exhaust liquid at a reduced rate.

In order to ensure satisfactory air intake, it is preferable that the overall axial length $L_1$ between the end the annular skirt 102 and the end of the annular skirt 104 is arranged as short as possible, but in the extent that the skirts can completely close the air intake port 100 having the axial length $L_2$ when the piston 101 is positioned at the end of stroke of the piston 101.

Figure 3:
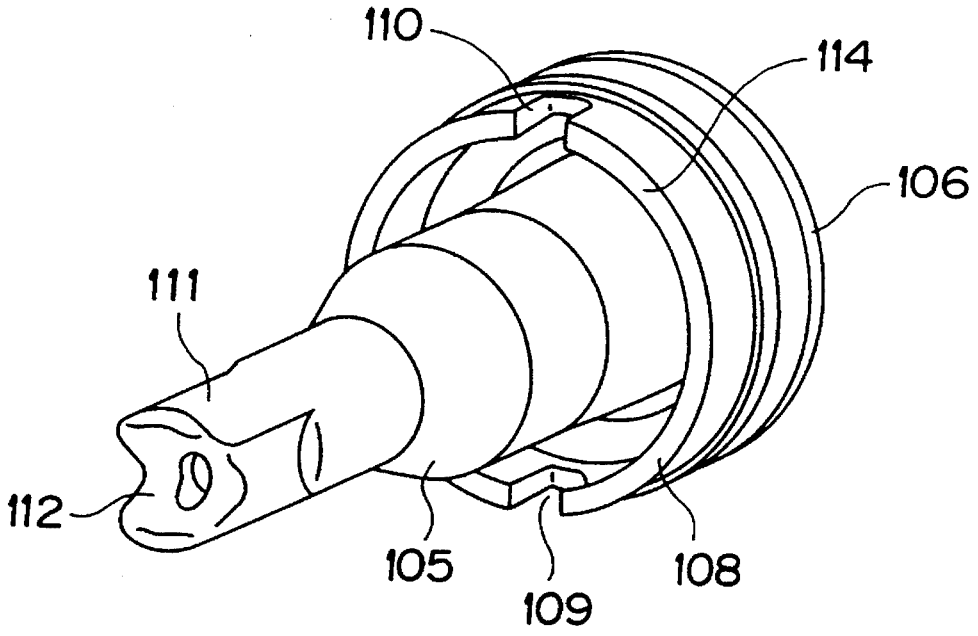
FIGS. 3, 4, 5 and 6 are schematic perspective views of a second embodiment of the invention and its variations.
Figure 7:
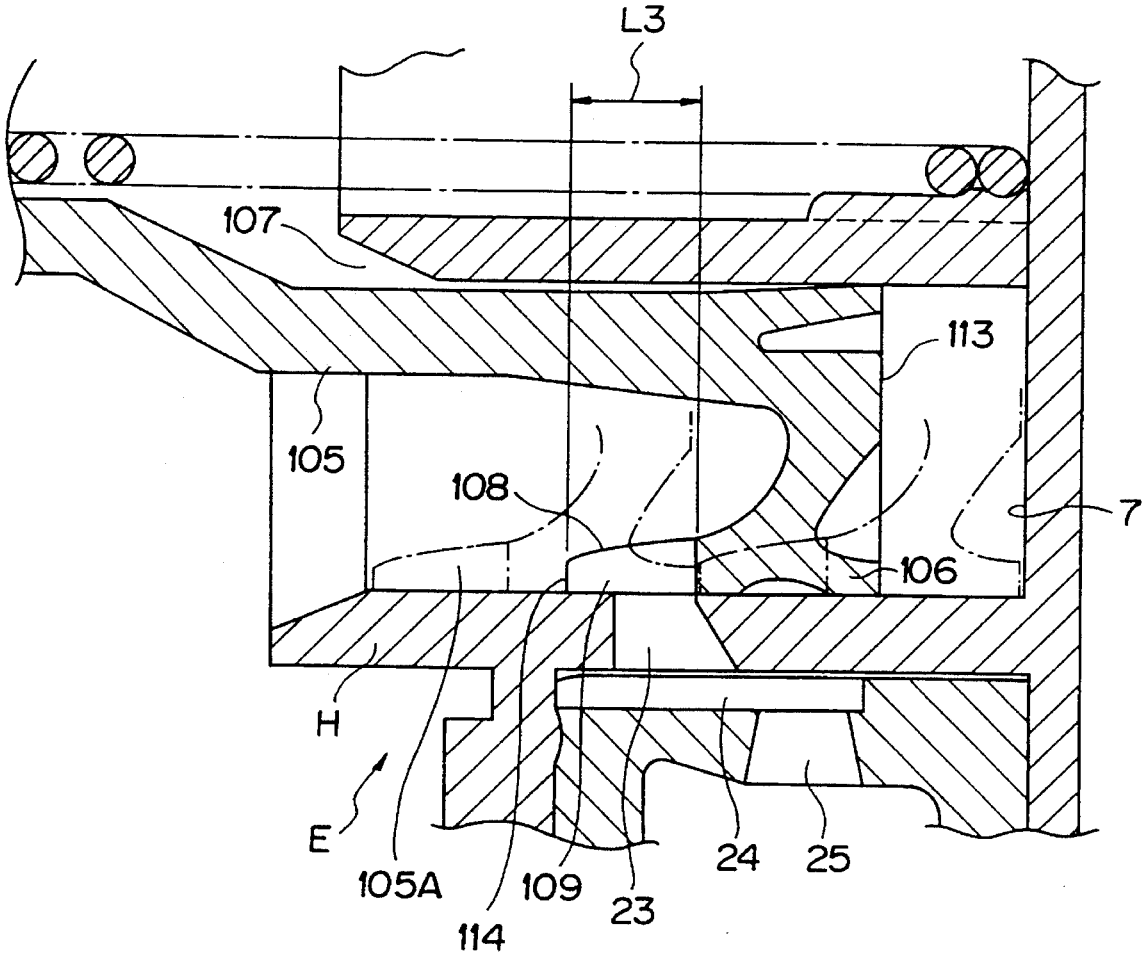
FIG. 7 is an enlarged partial sectional side view of the embodiment of the piston of FIG. 3, showing the piston under an operating condition.

FIG. 3 is a schematic perspective view of a second embodiment of the piston according to the invention, which is generally indicated by reference numeral 105. FIG. 7 is an enlarged partial sectional side view of the embodiment of the piston of FIG. 3 under an operating condition.

In this embodiment, a trigger-type liquid dispenser for a piston according to the invention also has a construction identical with the one illustrated in FIG. 8 except the piston. Thus, the same component is indicated by the same reference numeral in FIG. 8.

As illustrated in FIGS. 3 and 7, the piston 105 is provided and integrally formed with a first annular skirt 106 and a second annular skirt 108. The first annular skirt 106 extends at the approach end (or the bottom wall 7 side of the cylinder H) and held in close contact with the inner wall surface of the cylinder H. The second annular skirt 108 extends at the stroke end (or the opening 107 side of the cylinder H) and also held in close contact with the inner wall surface of the cylinder H.

Said second annular skirt 108 extending at the stroke end is provided with a notched section, (two notched sections 109, 110 in the illustrated embodiment) at positions corresponding to the air intake port 23.

A head 111 of the piston 105 is also provided with a horizontal groove 112 which receives the press member 3 of the trigger 2. Since the horizontal groove 112 is fixedly provided in a relative position relating to the fixed cylinder H, the above described positions corresponding to the air intake port 23 is fixedly defined by defining the positions of the notched sections 109 and 110 relative to the groove 112.

A length $L_3$ of the notched sections 109 and 110 is, as shown by a broken line 105A in FIG. 7, so determined that the piston 105 can completely close the air intake port 23 when it is located at the stroke end position.

Because of the provision of the notched sections 109 and 110, the air intake port 23 is located vis-a-vis the notched sections 109 and 110 to ensure air to be introduced into the liquid container even when the trigger 2 is moved by only a short stroke and the piston 105 is made to halt at a position as indicated by a solid line in FIG. 7.

As indicated by a broken line in FIG. 7, an end surface 113 of the piston 105 abuts the bottom wall 7 of the cylinder H at the approach end position, as in the case of a conventional piston illustrated in FIG. 8.

Figure 4:
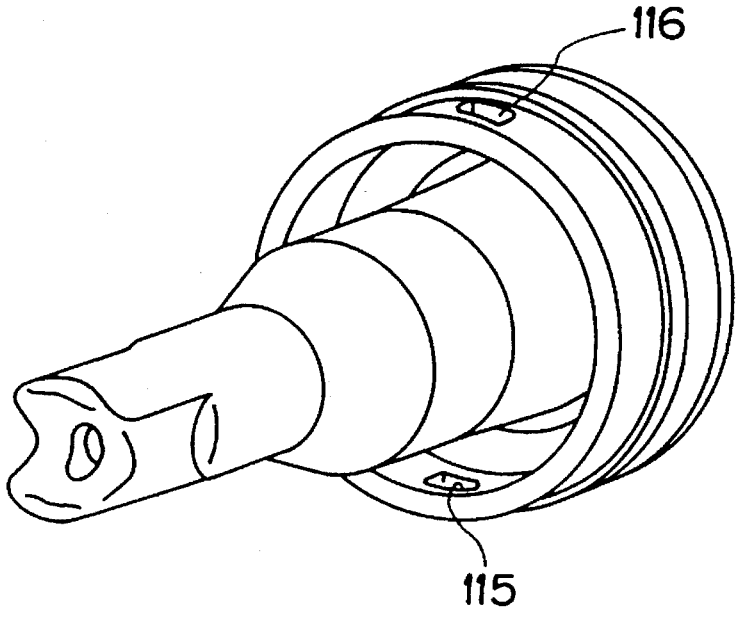
Figure 5:
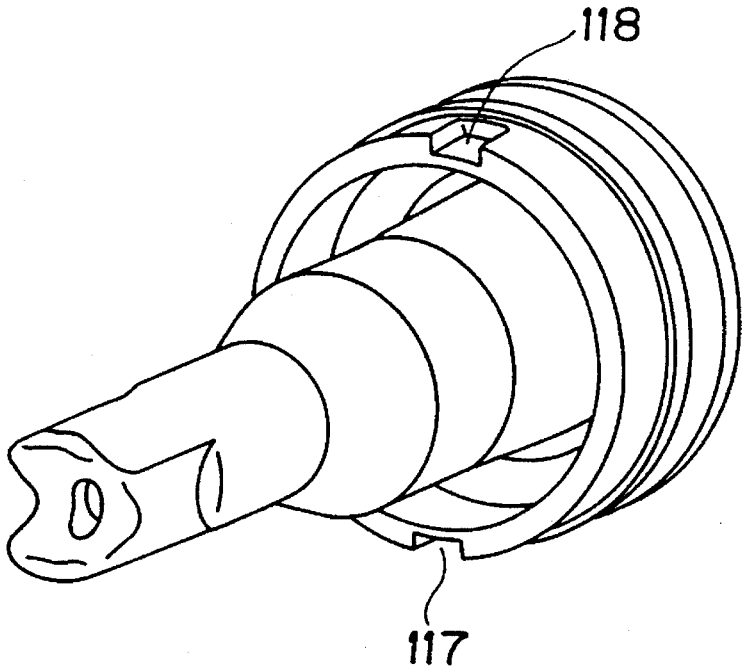

The notched sections 109 and 110 of a first variation of the embodiment of FIGS. 3 and 7 which are cut from an edge 114 of the annular skirt 108 may be replaced by a pair of through holes 115 and 116 as shown in FIG. 4, illustrating a second variation of the second embodiment. Alternatively, they may be replaced by a pair of recesses 117 and 118 as shown in FIG. 5, illustrating a third variation of the second embodiment.

Figure 6:
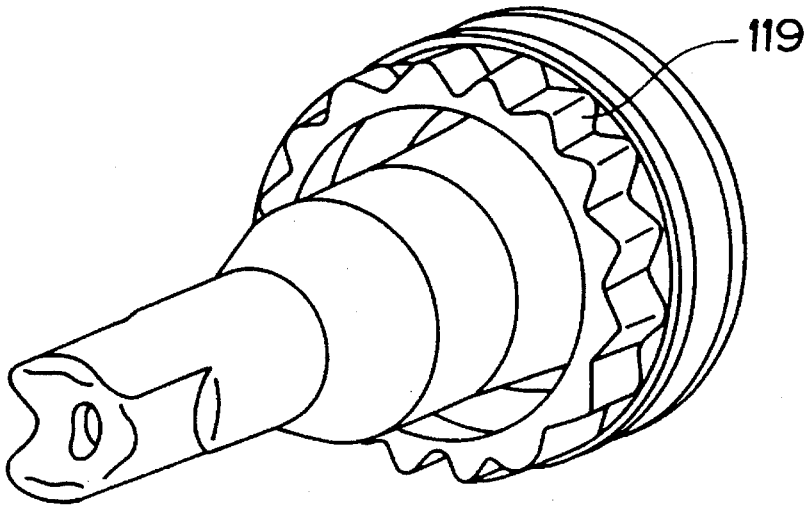

Still alternatively, the notched sections may be replaced by a series of axially extended and peripherally arranged slots 119 of a cogwheel as shown in FIG. 6, illustrating a fourth variation of the second embodiment. Such an arrangement is advantageous in that the air intake port 23 of the cylinder H may be peripherally displaced anywhere without adversely affecting its operational effect.

According to the invention as described above, air is securely and surely introduced into the liquid container even if the trigger is moved repeatedly by only a short stroke in order to exhaust liquid at a reduced rate so that the container is prevented from deformation or collapse due to reduced internal pressure and operates properly for liquid discharge without entailing any structural complication and increase in the number of components and assembling steps.

What is claimed is:

1. A piston of a pump section of a trigger-type liquid dispenser to be moved back and forth by a trigger, said piston having a first annular skirt extending at an approach end of the piston and a second annular skirt extending at a stroke end of the piston and formed integrally with the first annular skirt and forming a curved portion between said first annular skirt and said second annular skirt, said annular skirts being held in close contact with an inner wall surface of a cylinder of the pump section, an overall axial length of said first and second annular skirts being selected to close an air intake port provided on a peripheral wall of the cylinder of the pump section when the trigger is in an unactuated position, and to open the air intake port when the trigger is moved from the unactuated position, said curved portion having an axial length smaller than an axial length of the air intake port.

2. A piston of a pump section of a trigger-type liquid dispenser to be moved back and forth by a trigger, said piston having a first annular skirt extending at an approach end of the piston and a second annular skirt extending at a stroke end of the piston and formed integrally with the first annular skirt, said annular skirts being held in close contact with an inner wall surface of a cylinder of the pump section, said second annular skirt at the stroke end of the piston being provided with at least one notched section located at a position corresponding to said air intake port bored through a peripheral wall of said cylinder.

* * * * *